US008950612B2

(12) United States Patent
Turner

(10) Patent No.: US 8,950,612 B2
(45) Date of Patent: Feb. 10, 2015

(54) HYBRID SHIPPING CONTAINER

(75) Inventor: Todd T. Turner, Corydon, IN (US)

(73) Assignee: Macro Plastics, Inc., Fairfield, CA (US)

( * ) Notice: Subject to any disclaimer, the term of this patent is extended or adjusted under 35 U.S.C. 154(b) by 43 days.

(21) Appl. No.: 13/995,375

(22) PCT Filed: Dec. 21, 2011

(86) PCT No.: PCT/US2011/066545

§ 371 (c)(1),
(2), (4) Date: Jun. 18, 2013

(87) PCT Pub. No.: WO2012/088297

PCT Pub. Date: Jun. 28, 2012

(65) Prior Publication Data

US 2013/0270263 A1 Oct. 17, 2013

Related U.S. Application Data

(60) Provisional application No. 61/425,970, filed on Dec. 22, 2010.

(51) Int. Cl.

| | |
|---|---|
| ***B65D 88/00*** | (2006.01) |
| ***B65D 21/02*** | (2006.01) |
| ***B65D 88/12*** | (2006.01) |

(Continued)

(52) U.S. Cl.

CPC ..... *B65D 88/123* (2013.01); *B65D 88/022* (2013.01); *B65D 15/22* (2013.01); *B65D 21/0215* (2013.01)

USPC ..... 220/1.5; 220/23.86; 206/499; 206/512; 206/386; 206/504

(58) Field of Classification Search

CPC ... B65D 88/022; B65D 15/22; B65D 21/0215

USPC ..... 220/1.5, 23.86, 23.87, 23.91, 8, 4.26; 206/386, 499, 503, 514; 108/156

See application file for complete search history.

(56) References Cited

U.S. PATENT DOCUMENTS

| | | | |
|---|---|---|---|
| 749,199 | A | 1/1904 | Jones |
| 757,569 | A | 4/1904 | Simon |

(Continued)

FOREIGN PATENT DOCUMENTS

| | | | |
|---|---|---|---|
| DE | 8627708.1 | U1 | 12/1986 |
| EP | 0168060 | A2 | 1/1986 |

(Continued)

OTHER PUBLICATIONS

United States Patent and Trademark Office; The International Search Report and Written Opinion for PCT/US11/66545; May 1, 2012; pp. 1-7; United States Patent and Trademark Office; USA.

(Continued)

*Primary Examiner* — Robert J Hicks
*Assistant Examiner* — Kareen Rush
(74) *Attorney, Agent, or Firm* — Wyatt, Tarrant & Combs, LLP; Matthew A. Williams

(57) ABSTRACT

A shipping container comprising a cradle portion, including a plurality of upright members, formed of a first material and a basket formed of a second material wherein when a first shipping container is stacked on a second shipping container the load of the first shipping container is transferred through the plurality of upright members of the second container.

18 Claims, 15 Drawing Sheets

(51) Int. Cl.
*B65D 88/02* (2006.01)
*B65D 8/00* (2006.01)

(56) References Cited

U.S. PATENT DOCUMENTS

| | | | | |
|---|---|---|---|---|
| 2,561,143 | A | 7/1951 | Schmitz | |
| 2,688,420 | A | 9/1954 | Bishop et al. | |
| 3,480,178 | A | 11/1969 | Morgan | |
| 4,244,283 | A | 1/1981 | Georges | |
| 4,676,373 | A | 6/1987 | Schneider | |
| 5,390,847 | A | 2/1995 | Young | |
| 6,230,919 | B1 | 5/2001 | Guillin | |
| 6,598,540 | B2 * | 7/2003 | Austin et al. | 108/51.11 |
| 6,752,285 | B1 * | 6/2004 | Scalf | 220/4.32 |
| 7,093,731 | B2 * | 8/2006 | Karpisek | 220/1.5 |
| 2006/0037883 | A1 | 2/2006 | Stagnetto | |
| 2008/0073341 | A1 | 3/2008 | Avery | |
| 2008/0135547 | A1 | 6/2008 | Perkins | |
| 2009/0188829 | A1 | 7/2009 | McLeod | |

FOREIGN PATENT DOCUMENTS

| | | | |
|---|---|---|---|
| EP | 0472360 | A2 | 2/1992 |
| GB | 2112742 | A | 7/1983 |
| GB | 2189773 | A | 11/1987 |
| WO | 9718998 | A1 | 5/1997 |

OTHER PUBLICATIONS

Wenco; Product Solutions for your enterprise; catalog; 2002; pp. 1-16; Chile; www.wenco.cl.

Wenco; Product Solutions for your enterprise; catalog; 2006; pp. 1-17; Chile; www.wenco.cl.

* cited by examiner

HYBRID SHIPPING CONTAINER

CROSS-REFERENCE TO RELATED APPLICATIONS

This application is a National Stage of PCT/US2011/066545, which claims the priority to U.S. Provisional Application No. 61/425,970, filed Dec. 22, 2010, which is hereby incorporated herein by reference.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention generally relates to shipping containers, and more specifically to a hybrid shipping container in which the material containment portion is separated from the structural portion to optimize the performance of the shipping container while minimizing the cost and weight of the shipping container. The hybrid shipping container of the present invention is particularly suited for use in connection with the shipment and storage of bulk goods in general and fruit, such as apples, in particular.

2. General Background of the Invention

For many years, industries dealing in bulk goods, most notably the fruit industry, have been beset with problems stemming from containers that are poorly adapted for use in connection with the goods to be stored and shipped. The state of the art is currently defined by wooden crates. While generally not expensive, an important consideration in certain segments of the fruit industry such as apples where the fruit may be stored for as much as 10-12 months meaning a large number of container are needed, the very nature of wooden crates causes loss. For example, wooden containers cannot be easily cleaned. Wooden containers also cannot be provided with a sufficient surface area of air vents to allow the optimal amount of air circulation around perishable bulk goods such as apples without compromising the structure of the crate. In addition, wooden crates are assembled using hardware, such as nails and screws, that is present in the interior of the container and can damage bulk goods, such as fruit, stored therein. Finally, wooden crates are prone to splintering and have exposed hardware that can injure workers as they are loading the container.

Wooden containers are also prone to stacking issues since they cannot interlock. This leads to significant risk of harm to both the goods contained in such wooden crates and to workers since stacks of wooden crates are prone to toppling when bumped by a fork truck or similar pieces of equipment or when not properly aligned during stacking.

Wholly plastic containers have been developed for bulk goods applications, but such containers have not been well received in industry, and specifically in the fruit industry, because of the premium in cost versus a wood container and the much greater weight of wholly plastic containers. These cost and weight differentials result in large part from the fact that it takes a much greater weight of plastic to provide the rigidity and strength inherent in wood and similar materials. Another issue is the cost of shipping empty plastic containers, which do not nest since they must be stackable when filled, where wood crates can be broken down and assembled where needed. Thus, for an apple producer, the cost of enough such containers to hold 10-12 months of inventory is prohibitive, and the weight of such containers can also lead to floor loading issues, reducing the amount of goods that can be stored on a per square foot basis.

Thus, what is needed is a hybrid container design that provides a well-ventilated, hardware and splinter free storage compartment that can easily be cleaned. At the same time, the hybrid container must provide a sufficiently rigid structure that can withstand one or more tiers of stacking while providing an interlocking feature that ensures the containers are properly aligned when stacked and having a weight that is comparable to or less than a wooden crate.

SUMMARY OF THE INVENTION

The present invention relates to a shipping container comprising a cradle portion, said cradle portion being formed of a first material and further comprising a rectangular base assembly having a stacking surface defined in each corner portion of said base assembly and a plurality upright members arising from said corner portions of the base assembly; and a basket formed of a second material, said basket having a rectangular floor supported by said base assembly, a sidewall arising from a perimeter portion of said floor, said sidewall further comprising four corner portions in alignment with each corner portion of said base assembly, a stacking pad defined by an upper surface of each corner portion of said sidewall, a pocket defined in an upper portion each corner portion of said side wall, each pocket being adjacent to and underneath one of said stacking pads; wherein an upper portion of each said upright member is contained within one of said pockets.

BRIEF DESCRIPTION OF THE DRAWINGS

For a further understanding of the nature, objects, and advantages of the present invention, reference should be had to the following detailed description, read in conjunction with the attached figures, wherein like reference numerals denote like elements.

DETAILED DESCRIPTION OF THE INVENTION

Figure 1:
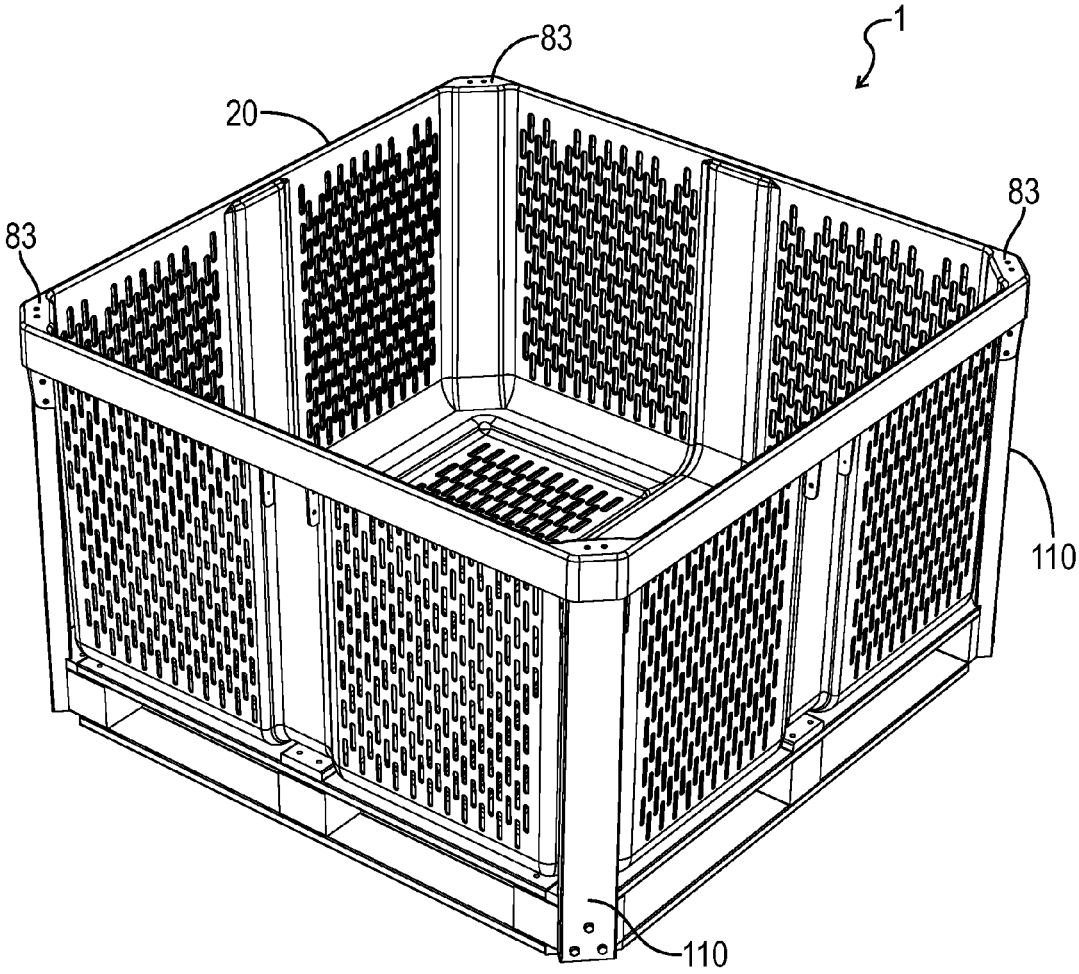
FIG. 1 is a perspective view of an embodiment of the invention.

The present invention is a shipping container for bulk goods. Container 1 comprises cradle portion 100 and basket 20. Cradle portion 100 comprises base assembly 200, corner upright members 110, and, in certain embodiments, side upright members 150.

Figure 2:
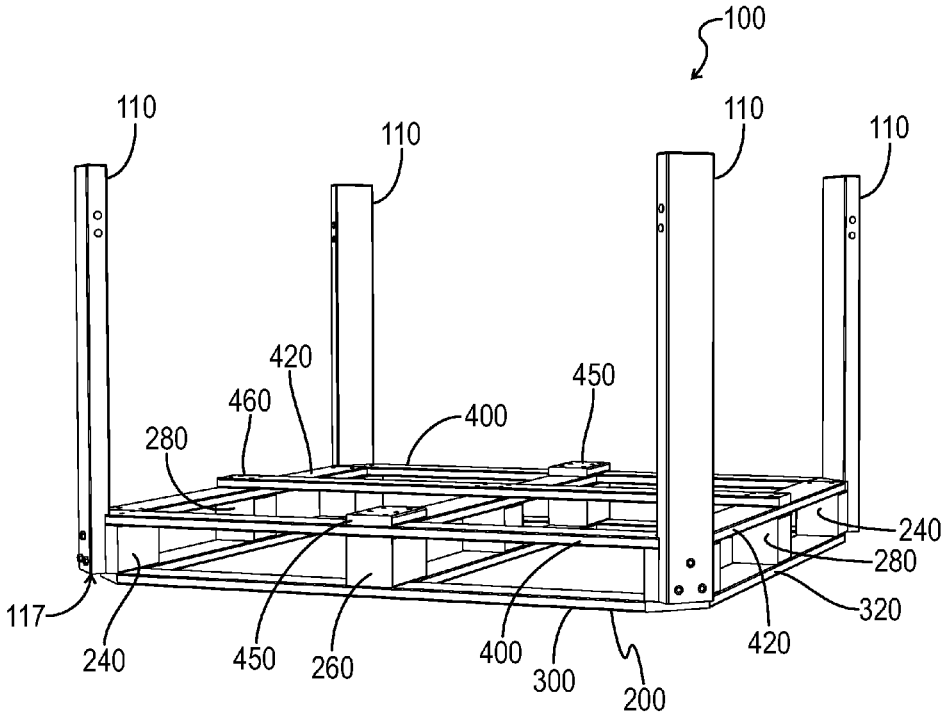
FIG. 2 is a perspective view of the cradle portion of the embodiment of the invention illustrated in FIG. 1.
Figure 3:
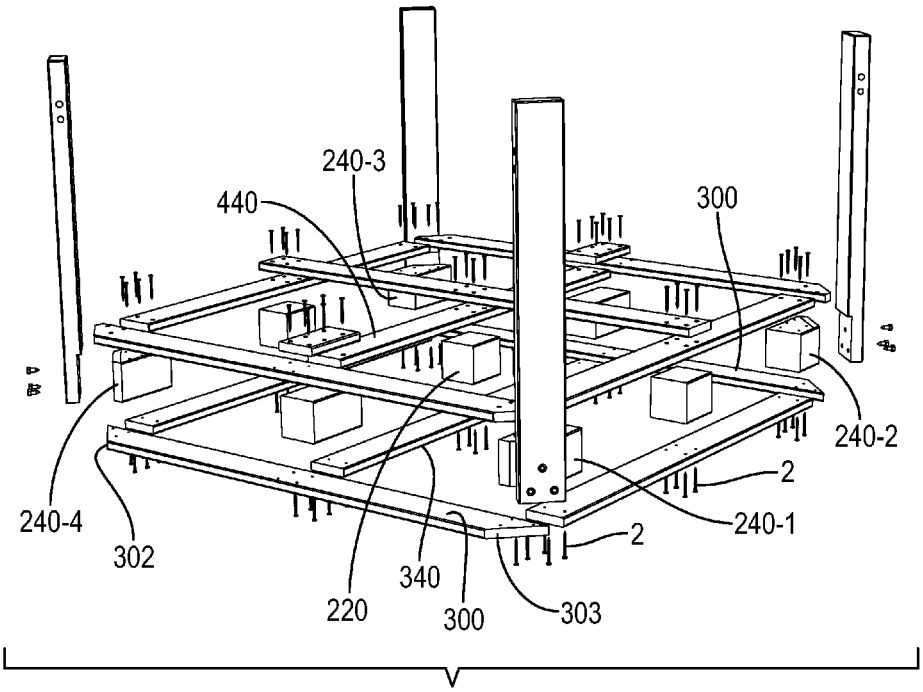
FIG. 3 is an exploded perspective view of the cradle portion of the embodiment of the invention illustrated in FIG. 1.

Referring now to FIGS. 2 and 3, base assembly 200 is generally rectangular in shape with the four corner portions 202 clipped off at a 45 degree angle. Base assembly 200 is comprised of a number of individual members that are joined together to form a rigid structure. The individual members of base assembly 200, as well as corner and side upright members 110 and 150, may be formed from any material with a sufficient degree of rigidity, strength, and resilience to withstand the weight of the goods to be loaded in basket 20 and the vertical stacking of multiple containers 1. One material that is particularly well suited for the construction of cradle portion 100 is wood. The individual members may be joined together using one or more of a number of known techniques for joining the type of material the members are formed from, including mechanical and adhesive techniques. When the material is wood, the use of a plurality of lag screws 2 at each point of affixation is an effective means of joining the individual members together to form cradle portion 100, and the various members may also be pre-drilled with holes H. Alternatively, nails, particularly ring shank nails, or staples may be used to join the various members.

The individual members of base assembly 200 include center support block 220, corner support blocks 240, first side support blocks 260, and second side support blocks 280. In the illustrated embodiment, each of support blocks 220, 260, and 280, has a length, width, and height, with center support block 220 and the side support blocks 260 and 280 generally having the shape of a rectangular prism.

Figure 9:
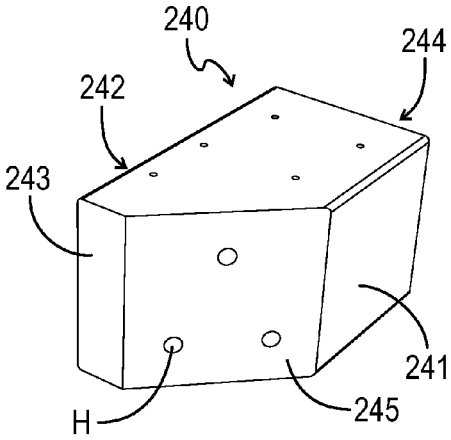
FIG. 9 is a perspective view of a corner support block of the embodiment of the invention illustrated in FIG. 1.
Figure 10:
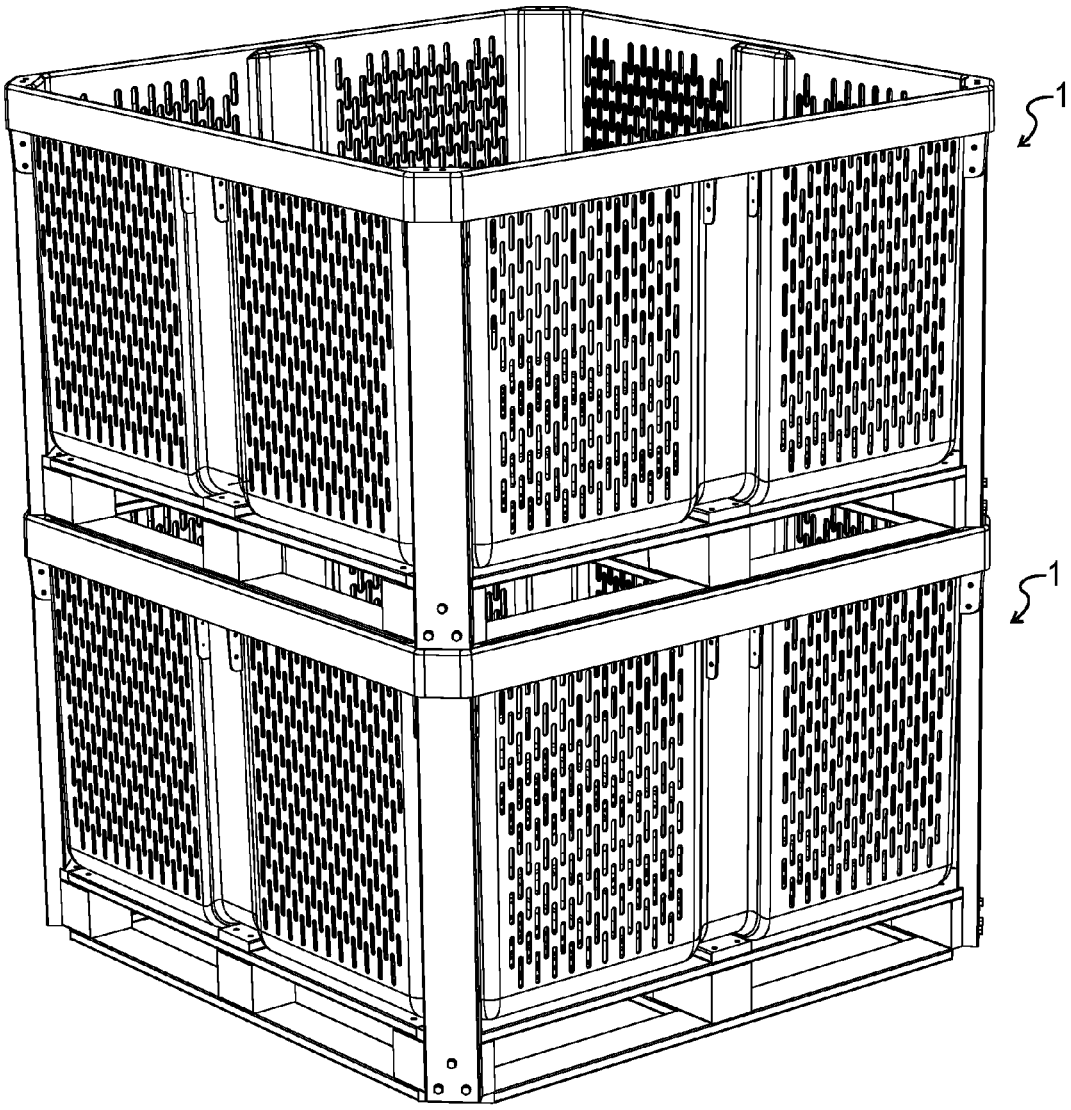
FIG. 10 is a perspective view showing a first container of the embodiment of the invention illustrated in FIG. 1 stacked on a second container of the same embodiment.

Each corner support block 240 (best seen in FIG. 9) is generally in the shape of an irregular pentagonal prism having a first pair of parallel sides 241, 242, where side 241 is shorter than side 242, that are perpendicular to a second pair of shorter, parallel sides, 243, 244, where side 243 is shorter than side 244, and oblique side 245 that connects side 241 to side 243. Oblique side 245 preferably forms a 45 degree angle with each of sides 241 and 243.

Corner support blocks 240 are arranged at the corner portions of base assembly 200 such that the facing sides of adjacent corner support blocks are identical. For example, in FIG. 3, side 242 of the corner block denoted as 240-1 faces side 242 of the corner block denoted as 240-4 and side 244 of the corner block denoted as 240-1 faces side 244 of the corner block denoted as 240-2.

In addition to the various support blocks, base assembly 200 also includes first pair of outer fork straps 300, second pair of outer fork straps 320, and central fork strap 340, wherein each of the fork straps is generally equal in width to the support blocks. Each of the first pair of outer fork straps 300 has oblique opposing end portions 302 having the same angle as the angle of oblique side 245 of corner support blocks 240. Each of oblique opposing end portions 302 of the first pair of outer fork straps 300 is attached to the bottom surface of a different corner block 240 such that each fork strap 300 is transverse to sides 242 of opposing corner blocks 240 and each oblique end portion 302 of the first pair of pair of outer fork straps 300 is spaced back from, and generally parallel to, oblique side 245 of corner block 240. The vertical portion of oblique end portion 302 serves as interlocking wall 303. Each first side support block 260 is affixed to the upper surface of one of the first pair of outer fork straps 300 such that an end portion of each first side support block 260 is aligned with an outer edge portion of each fork strap 300 and each support block 260 extends transversely toward the center of the base assembly 200. Opposing end portions of central fork strap 340 are affixed to the bottom surfaces of each first side support block 260. Center support block 220 is affixed to the upper surface of central forkstrap 340 at a central point along its length.

The opposing end portions of each of the second pair of outer fork straps 320 are attached to the bottom surface of corner blocks 240 such that each outer fork strap 320 is transverse to sides 244 of opposing corner blocks 240 and each end portion of fork straps 320 abuts an edge portion of fork straps 300. Each second side support block 280 is affixed to the upper surface of one of outer fork straps 320 at a central point along the length of fork straps 320.

Base assembly 200 further includes a first outer pair of basket support members 400, a second pair of outer basket support members 420, first central basket support member 440, and second central basket support member 460 wherein each of the support members has a width that is generally equal to the width of the support blocks. Each of the first outer pair of basket support members 400 has oblique opposing end portions having the same angle as the angle of oblique side 245 of corner support blocks 240. Each of the first pair of outer basket support members 400 is affixed to the upper surface of opposing corner blocks 240 and the upper surface of a first side support block 260 such that each outer basket support member 400 is above and parallel to the corresponding outer fork strap 300. Each oblique end portion of outer basket support members 400 is located adjacent to and in alignment with oblique side 245 of the corner support blocks 240.

The opposing end portions of each of the second pair of outer basket support members 420 are attached to the upper surface of opposing corner blocks 240 and the upper surface of the second side support 280 located between opposing corner blocks 240 such that each outer basket support member 420 is above and parallel to the corresponding outer fork strap 320.

The opposing end portions of first central basket support member 440 are affixed to the upper surfaces of the first pair of side supports 260 that extend transversely from fork straps 300 and basket support members 400 toward the center of base assembly 200 such that first central basket support 440 abuts basket support members 400 and is located above and parallel to central fork strap 340. First central basket support member is further attached at a central point to the upper surface of center support block 220.

The opposing end portions of second central basket support 460 are affixed to the upper surfaces of the second pair of outer basket support members 420 at a central point along the length of outer basket support members 420 coincident with the location of side supports 280 along the length of outer basket support members 420. Second central basket support member 460 is essentially transverse to each of outer basket support members 420. When second central basket support member 460 is affixed to outer basket support members 420 using mechanical fasteners such as lag screws 2, the fasteners are preferably driven through both end portions of second central basket support member 460 and outer basket support members 420 and into side support blocks 280. Second central basket support member 460 is further affixed at a central point to the upper surface of first central basket support member 440 coincident with the location where first central basket support member 440 is affixed to center support block 200. When such affixation is accomplished using mechanical fasteners such as lag screws 2, the fasteners are preferably driven through second central basket support member 460 and first central basket support member 440 and into center support block 200.

In the embodiment illustrated in FIGS. 2 and 3, base assembly 200 also includes reinforcing basket support members 450. In the illustrated embodiment, reinforcing basket support members 450 have a length generally equal to the length of side supports 260 and are affixed to the upper surface of outer basket support members 400 and the upper surface of first central basket support member 440 such that reinforcing basket support members 450 lap the butt joints between outer basket support members 400 and central basket support member 440. When reinforcing basket support members 450 are affixed using mechanical fasteners such as lag screws 2, the fasteners are preferably driven through reinforcing basket support members 450 and outer basket support members 400 or first central basket support member 440 and into side support blocks 260.

Alternatively, in an embodiment that is not shown, reinforcing members 450 may extend toward the center of base assembly 200 and abut second central basket support 460 where second central basket support 460 is affixed to the upper surface of first central basket support member 440. In this embodiment, reinforcing members 450 are additionally affixed to first central basket support member 440 adjacent to where first central basket support member 440 passes under second central basket support member 460. In this embodiment, when reinforcing basket support members 450 are affixed using mechanical fasteners such as lag screws 2, the fasteners are preferably driven through reinforcing basket support members 450 and outer basket support members 400 and first central basket support member 440 and into side support blocks 260 and center support block 220.

In a preferred embodiment, side support blocks 280 have a horizontal cross-section that is square, where the length and width of the square is equal to the width of outer fork straps 320, outer basket support members 420, and second central basket support member 460. This enables side support blocks 280 to be fully supported by outer fork straps 320 and to support the full width of outer basket support members 420 and second central basket support member 460. Similarly, where reinforcing support members 450 have a length approximately equal to the length of side support blocks 260, center support block 220 preferably has a horizontal cross-section that is square, where the length and width of the square is equal to the width of central fork strap 340, first central basket support member 440, and second central basket support member 460. Where reinforcing support members 450 extend to and abut second central basket support member 460, center support block 220 preferably has a horizontal cross-section that is rectangular, with the length of the rectangular shape being aligned parallel to central fork strap 340 and being sufficient in length to adequately support the end portions of reinforcing support members 450 adjacent to central basket support member 460.

Figure 6:
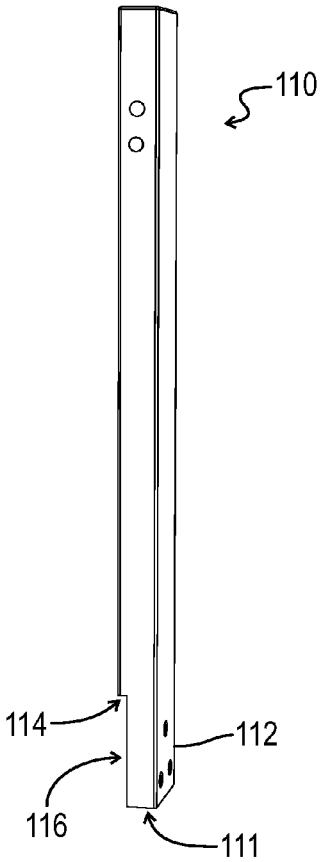
FIG. 6 is a detail view of an upright member of the embodiment of the invention illustrated in FIG. 1.

Corner upright members 110 are generally rectangular in cross-section. First end portion 112 of each corner upright member 110 is rabbeted to form ledge 114 and mating surface 116 (best seen in FIG. 6). Each corner upright member 110 is affixed to base assembly 200 such that mating surface 116 is adjacent to oblique side 245 of corner support block 240 and to oblique end portions 402 of outer basket support members 200 and ledge 114 rests upon the upper surface of outer basket support members 400 along oblique end portion 402. Mating surface 116 has a length that is equal to the combined thickness of corner support block 240 and outer basket support member 400 such that lower surface 111 end of corner upright member 110 is coplanar with and cooperates with the bottom surface of corner support block 240 to form stacking surface 117. Ledge 114 has a depth equal to the distance oblique end portions 302 of outer fork straps 300 are spaced back from oblique side 245 of corner support blocks 240.

Figure 11:
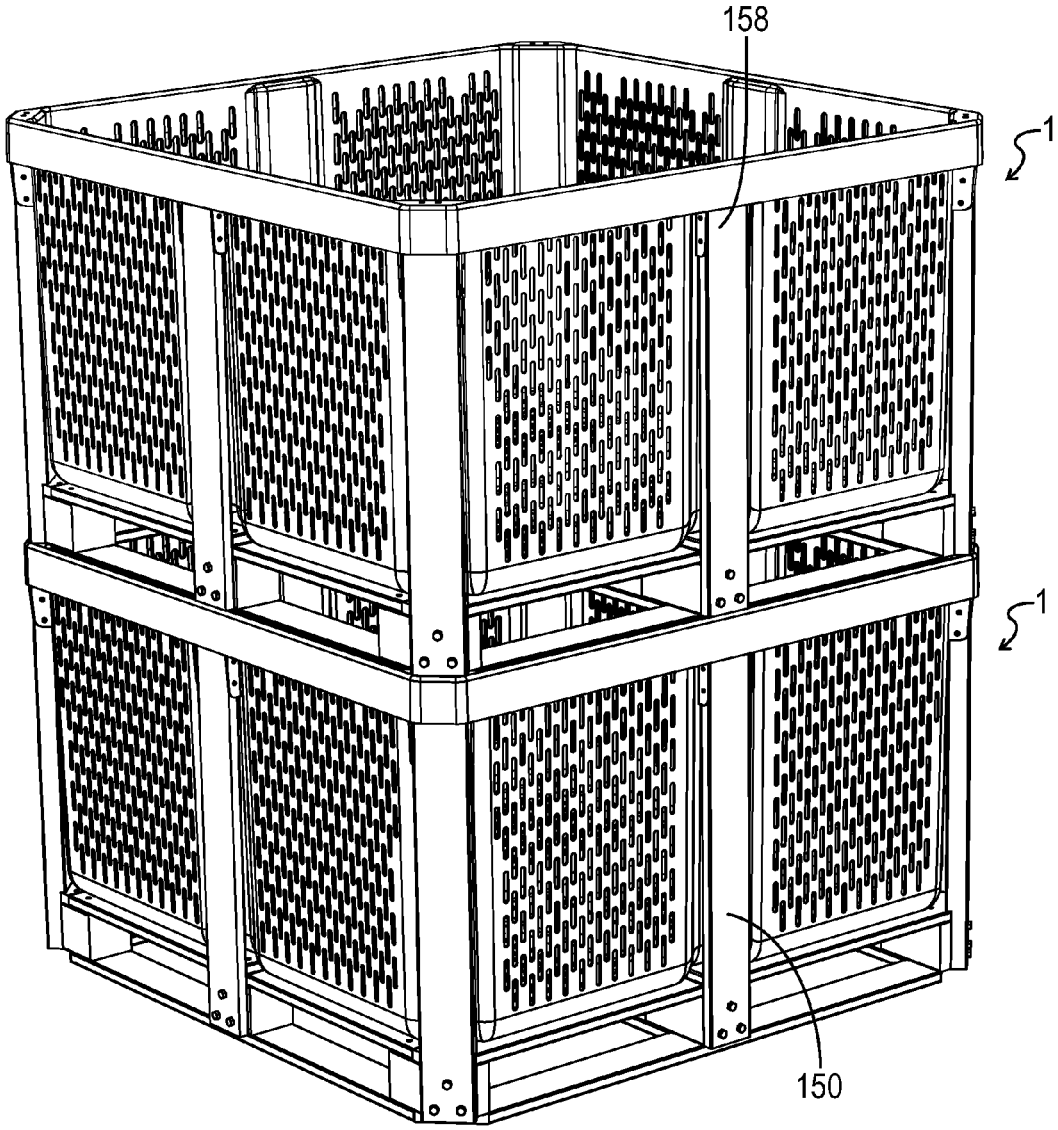
FIG. 11 is a perspective view showing a first container of an alternate embodiment of the invention stacked on a second container of the same alternate embodiment.
Figure 12:
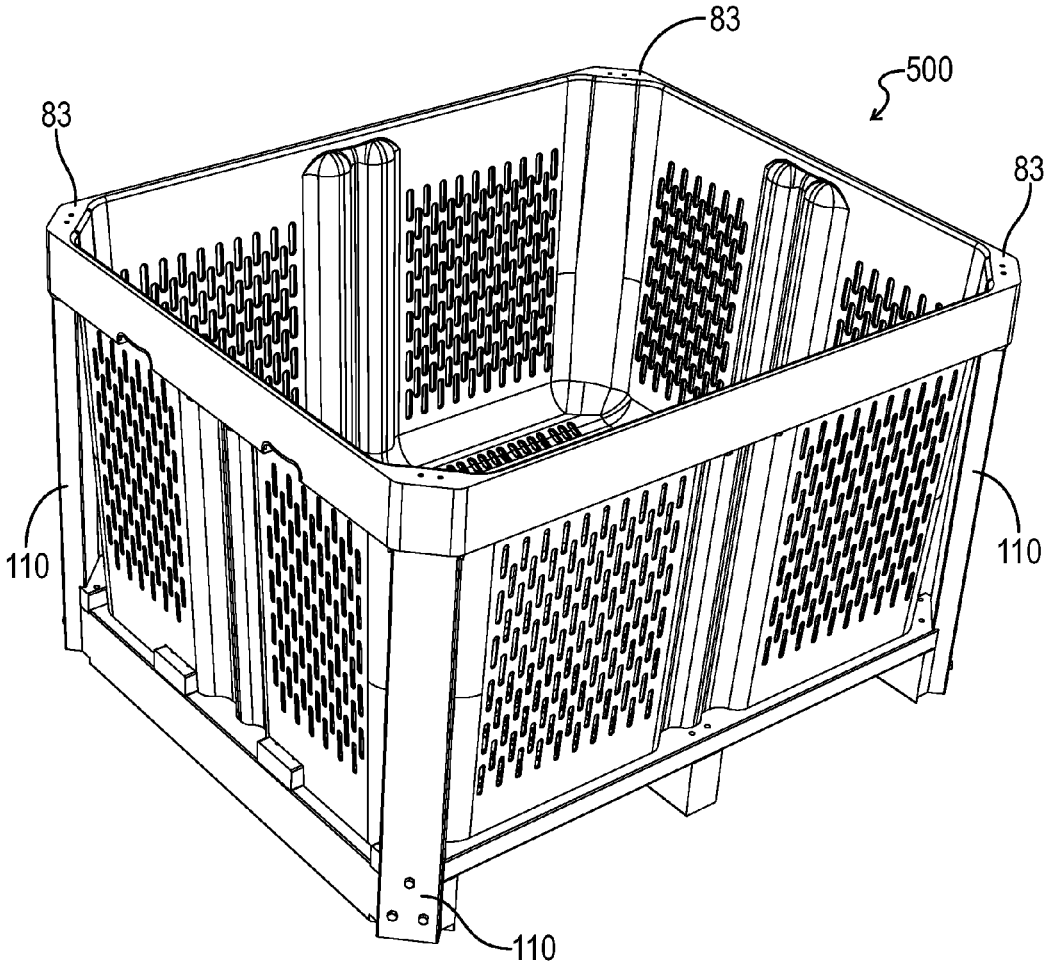
FIG. 12 is a perspective view of an alternate embodiment of the invention.

When needed due to the hydraulic load being asserted against the sides of the container by the load to be placed in basket 20, side upright members 150, shown in the embodiment illustrated in FIG. 11, may be used to prevent basket 20 from bulging outward at a mid-portion of container 1. Side upright members 150 generally have a rectangular cross section. Side upright members 150 are attached to an exterior edge portion of side support blocks 260 and 280 such that the lower end portions of side upright members 150 do not extend below the bottom surfaces of side support blocks 260 and 280 and may be located above bottom surfaces of side support blocks 260 and 280. When the lower end portions of side upright members 150 are coplanar with the bottom surfaces of side support blocks 260 and 280, a portion of the vertical load of a first container 1 will be transferred through each side upright member 150 to a corresponding side upright member 150 in a second container 1 located below the first container 1 in a vertical stack via lip portion 82 of basket portion 20 of lower container 1 intermediate the corresponding side upright members 150 of the first and second containers 1 as best seen in FIG. 11.

In an alternate embodiment, which is not illustrated, particularly well-suited for the storage and shipment of dense materials, a first end portion of side upright members 150 are rabbeted similarly to corner upright members 110 to form ledge 154 and mating surface 156 to enable side upright members 150 to carry a significant portion of the load. In this embodiment, each side upright member 150 is affixed to base assembly such that mating surface 156 is adjacent to one of side support blocks 260 and 280. In the case of side upright members 150 that are affixed adjacent to one of the first pair of side support blocks 260, ledge 154 rests on the upper surface of reinforcing members 450. Mating surface 156 has a length equal to the combined thickness of side support block 260, side basket support member 400, and reinforcing member 450 such that the end of side upright member 150 is flush with bottom surface 266 of side support 260. In the case of side upright members 150 that are affixed adjacent to one of the second pair of side support blocks 280, ledge 154 rests on the upper surface of second central basket support member 460. Mating surface 156 has a length equal to the combined thickness of side support block 260, side basket support member 420, and second central basket support member 460 such that the end of side upright member 150 is flush with bottom surface 286 of side support 280. In the described embodiment, the length of mating surface 156 is identical for all four side supports 150. In the event that basket assembly 200 does not utilize reinforcing members 450, the length of mating surface 156 would be adjusted accordingly for side upright members 150 that are affixed adjacent to side supports 260. Ledge 154 has the same depth, D, as ledge 114. In this configuration, outer fork straps 300 and 320 define a notch with a depth equal to the depth of ledge 154 coincident with where the forkstraps pass under side support blocks 260 and 280, similar to the space oblique end portions 302 of fork straps 300 are set back from oblique side 245 of corner support blocks 240.

Figure 4:
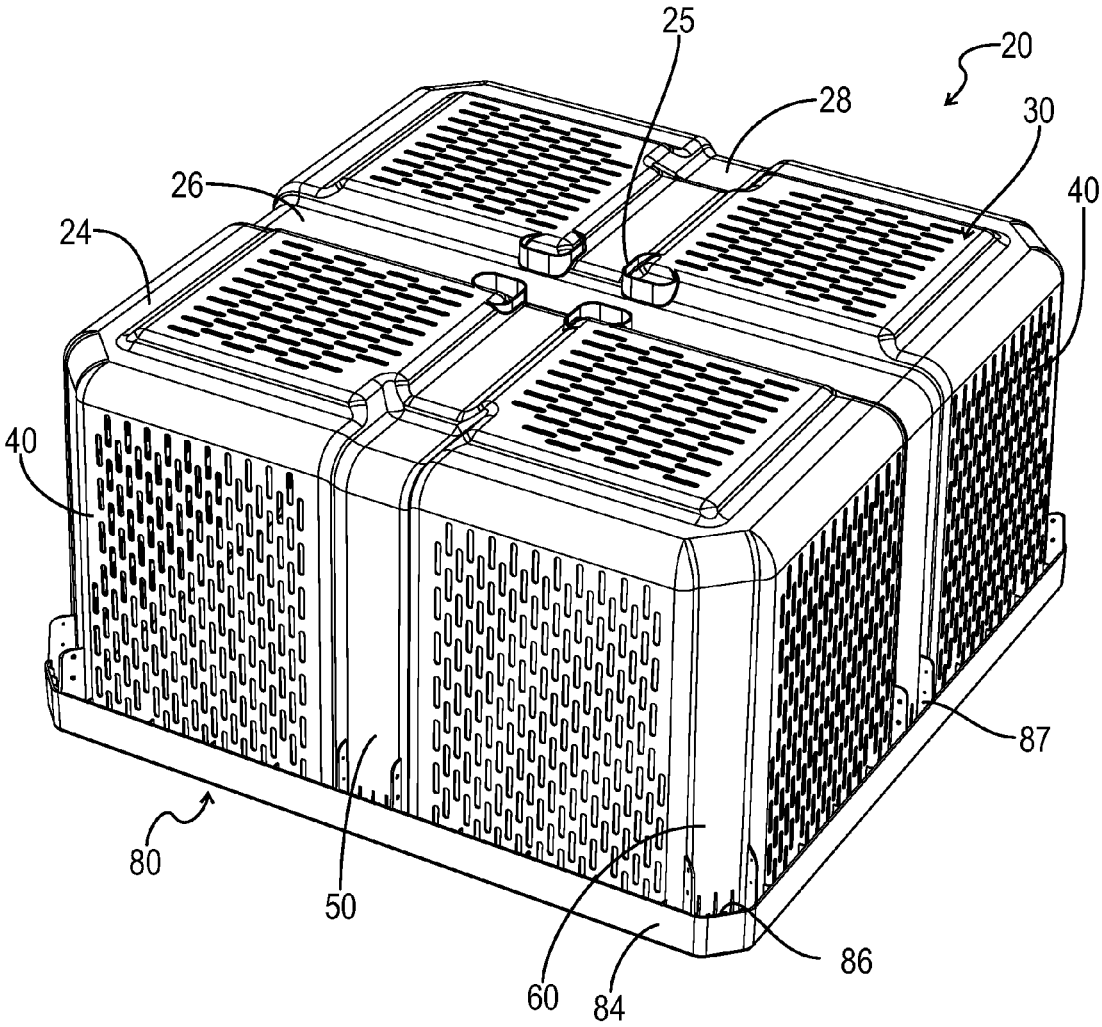
FIG. 4 is a perspective view of the basket of the embodiment of the invention illustrated in FIG. 1.
Figure 5:
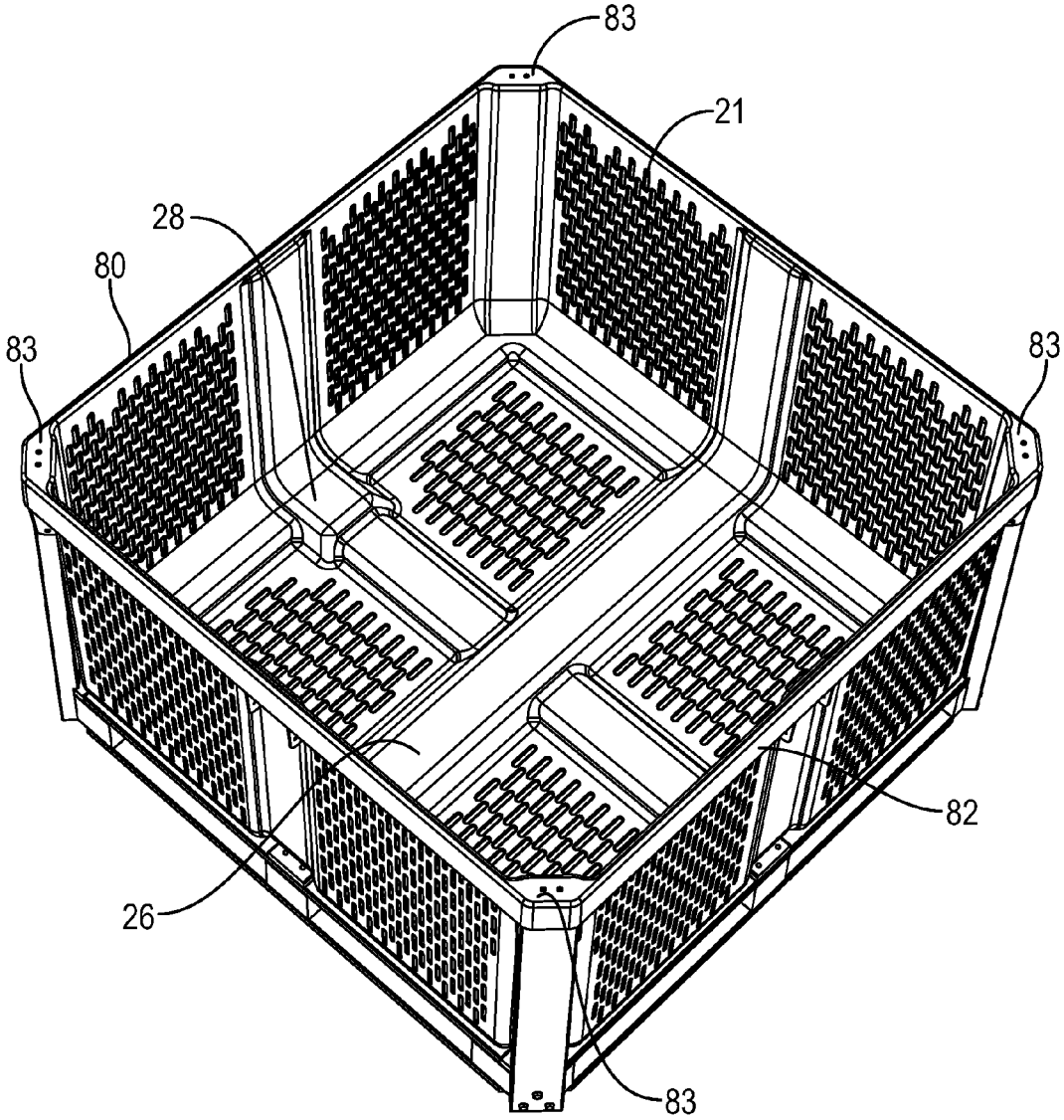
FIG. 5 is an alternate perspective view of the embodiment of the invention illustrated in FIG. 1.

Basket 20 is preferably formed from a polymeric material. Basket 20 includes floor 22 and four sides 40. Floor 22 is contoured such that the portions of lower surface 24 positioned above basket support members 400, 420, 440, 460 and, where used, reinforcing basket support members 450, are in contact with and supported by the upper surface of the basket support members 400, 420, 440, 460, and, where used, reinforcing members 450. This is accomplished by forming raised boss 26 in floor 22 to align with second central basket support 460. Where reinforcing basket support members 450 are used, as in the illustrated example, raised bosses 28 are formed to align with reinforcing members 450. In the case of reinforcing members 450 that extend to and abut second central basket support 460, raised bosses 28 similarly intersect raised boss 26 to essentially form a second raised boss that traverses the length of floor 22. In the embodiment illustrated in FIG. 4, flanges 25 extend downward from lower surface 24 of floor 22. Flanges 25 are located proximate to the intersection point of first central basket support member 440 and second basket support member 460 such that each flange 25 frictionally engages the edge portions of first central basket support member 440 and second basket support member 460 to provide basket 20 with additional resistance to sliding relative to base assembly 200. The function of flanges 25 could also be accomplished using alternate structures that would provide the same benefit. For example, pairs of downwardly extending posts that frictionally engage the opposing edge portions of central basket support member 440 and second basket support member 460 proximate to their intersection would provide the same benefit.

To maximize container volume, floor 22 can be formed with depressions 30 between the portions of floor 22 that align with basket support members 400, 420, 440, 460 and, where used, reinforcing members 450. Depressions 30 are sufficiently shallow to ensure that the portion of lower surface 24 of floor 22 included in depressions 30 does not extend below the lower surfaces of basket support members 400, 420, and 440.

In an alternate embodiment of container 1, the portions of the underneath surface of second central basket support member 460 extending between outer basket support members 420 and first central basket support member 440 are extended downward into the same plane as the lower surfaces of basket support members 400, 420, and 440 to further protect basket 20. This is accomplished by rabbeting the end portions of second central basket support member 460 where it intersects outer basket support members 220 and dadoing a central portion of second central basket support member 460 where it intersects first central basket support member 440. Alternatively, this can be accomplished by scabbing an additional thickness of material onto these portions of the underneath surface of second central basket support member 460.

Sides 40 arise from the perimeter of floor 22, preferably with a radius being formed with floor 22. Sides 40 are generally vertical but may be slightly obtuse with respect to floor 22 to allow baskets 20 to be nested for shipping empty when they are not installed in cradle portion 100. Each Side 40 is connected to adjacent sides 40 through chamfered corner portions 60 that generally form a 45 degree angle with respect to adjacent sides 40, although the actual points of connection between chamfered corner portions 60 and sides 40 may have a radius to reduce the concentration of stress and facilitate the formation of basket 20.

The end portions of sides 40 and chamfered corner portions 60 terminate in stiffening lip 80 that defines the upper perimeter of basket 20. Lip 80 includes ledge 82 that extends outward from side walls and return flange 84 that extends generally downward from ledge 82. The thickness and length of ledge 82 and return flange 84 are selected to provide the requisite amount to stiffness to basket 20 to handle the outward pressure exerted on sides 40 by the load expected to be placed in basket 20. Ledge 82 may have one or more interim step downs to provide additional rigidity while minimizing the amount of material used.

At the upper portions of chamfered corner portions 60, ledge 82 and return flange 84 cooperate to form pocket 86 for receiving second end portion 118 of corner upright member 110. Pocket 86 is further defined by attachment ribs 88 that extend downward from ledge 82 to a point below the lower end of return flange 84. The edge portions of attachment ribs 88 are integrally connected to the inner edge of return flange 84 and to outer surface 64 of chamfered corner portions 60. Within pocket 86, one or more reinforcing ribs 90 integrally connected at a first end to ledge 82 and along an edge to return flange 84. Second end 92 of reinforcing rib 90 does not extend beyond the end of return flange 84. Second end 92 of reinforcing rib is 90 may be beveled or rounded over to facilitate the insertion of second end portion 118 of corner upright member 110 into pocket 86. Reinforcing ribs have a width sufficient to engage corner upright member 110 and hold it firmly against outer surface 64 of chamfered corner portion 60 at least within pocket 86. In certain embodiments, outer surface 64 of chamfered corner portion may have one or more raised areas 65 to establish the proper location of corner upright member 110.

In embodiments of container 1 that include side upright members 150, additional pockets 87, similar to pockets 86, are defined to receive second end portion 158 of side upright member 150. Where side upright members 150 are rabbeted similarly to corner upright members 110, the additional pockets 87 extend further toward the center of basket 20 to allow side upright members 150 to align vertically when ledges 154 (not shown) are engaged with a portion of the basket support members. In this configuration, the portions of ledge 82 opposite pockets 87 in a lower container 1 will engage the lower ends of side upright members 150 and the lower surfaces of the side support blocks 260 and 280 exposed by the notches in outer fork straps 300 and 320 to direct a portion of the load vertically through side upright members 150.

In the illustrated embodiment, sides 40 include vertical stiffening section 50 at a central portion of sides 40. In the illustrated embodiment, vertical stiffening section 50 is a trough defined in the exterior of side 40 that extends toward the center of basket 40 with pocket 86 being defined at the upper end portion of the trough. In this particular embodiment, the depth of the trough is selected to allow side upright members 150, when used, to be in a vertical orientation when the lower end portions of side upright member 150 are affixed to the exterior portion of side support blocks 240 and 260 and the upper end portions of side upright members 150 are secured in pockets 87 at the upper end portion of the trough. The effect of the trough shape of vertical stiffening section 50 is to provide each side 40 with additional rigidity to resist to the hydraulic pressure exerted on the interior of sides 40 by the materials place in basket 20.

Basket 20 can be formed with a plurality of vents 21 that allow airflow around bulk goods stored in the container as shown in the illustrated embodiment. This is particularly advantageous when the bulk product is fruit such as apples. Depending on the ventilation needs of the goods being stored and shipped in container 1, the number and location of the vents can vary from what is shown. For example, basket 20 may be vented only in the bottom in some applications. In other applications, basket 20 may not have any venting.

Once cradle portion 100 is formed from its various members, the assembly of container 1 is completed by inserting basket 20 into cradle portion 100 such that corner upright members 110 are received into pockets 86; when present, side upright members 150 are received into pockets 87. The bottom surface of ledge 82 inside each pocket 86 and 87 rests directly on the end of upright members 110, and 150 when present, such that there is no gap between the bottom surface of ledge 82 and the end of upright members 110, and 150 when present. Corner upright members 110, and side upright members 150 when present, are then affixed to attachment ribs 88, preferably by a plurality of lag screws 2 driven though each attachment rib and into upright members 110, and 150 when present, and by one or more lag screws 2 driven downward through ledge 82 into the end portions of upright members 110, and 150 when present. The portions of lower surface 24 of basket 20 in alignment with basket support members 400, 420, 440, 460 (and/or reinforcing support members 450 when used) are either in contact with at least a portion of the upper surfaces of said support or are sufficiently close to said upper surfaces to contact them when basket 20 is loaded.

Figure 7:
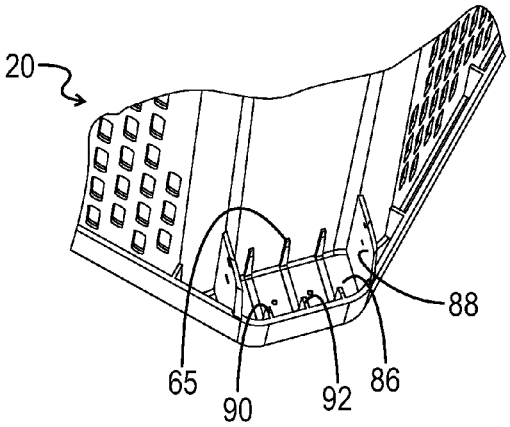
FIG. 7 is a partial perspective view of a portion of the basket of the embodiment of the invention illustrated in FIG. 1.
Figure 8:
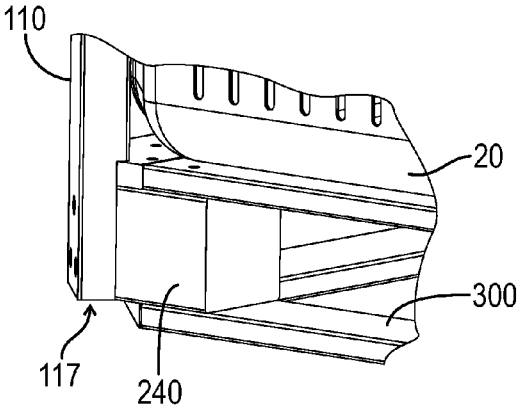
FIG. 8 is a partial perspective view of a portion the embodiment of the invention illustrated in FIG. 1.

Above pockets 86 defined in chamfered corner portions 60, the upper surface of ledge 82 of a first container 1 (the "lower container 1") forms stacking pad 83 to receive a second container 1 (the "upper container 1"). When upper container 1 is stacked onto lower container 1 as shown in FIGS. 7 & 8, corner stacking pads 83 of lower container 1 align with stacking surfaces 117 formed by the lower end of corner upright members 110 and the portion of the bottom surfaces of corner blocks 240 that are not covered by outer fork straps 300 and 320 of upper container 1. This positions the outer edge portions of outer fork straps 300 and 320 of upper container 1 within the upper perimeter of basket 20 of lower container 1 and just below the upper edge of basket 20. Thus, the outer fork straps 300 and 320 of upper container 1 exert no downward force on basket 20 of lower container 1 and the entire weight of upper container 1 is transferred to the floor through stacking pads 83 of lower container 1 and corner upright members 110. Moreover, the outer edge portions of outer fork straps 300 and 320 of upper container 1 are closely aligned with the inner surface of basket 20 of lower container 1, causing upper container 1 to align properly with lower container 1 and preventing upper container 1 from slipping relative to lower container 1.

Depending on the load, containers 1 can also be stacked more than two containers high with the each container 1 transferring the load from above to the container 1 below it (or the floor in the case of the lowest container 1) solely through corner upright members 110 (and side upright members 150 in certain embodiments). For example, in a three-high stack of containers 1, middle container 1 transfers the load of upper container 1 to lower container 1 though its corner upright members 110. Lower container 1 transfers the load of upper container 1 and middle container 1 to the surface on which lower container 1 rests.

Illustrated in FIGS. 12-19, is an alternate embodiment of the invention, container 500. Container 500 comprises cradle portion 510 and basket 520. Cradle portion 510 further comprises base assembly 600 and corner upright members 110. Cradle portion 510 is configured such that when a second container 500 is stacked on top of a first container 500, the load of the second container 500 is transferred solely to upright members 110 of the first container 500 and stacking pads 83 of basket 520 adjacent to the upper surface of upright members 110. As with the foregoing embodiments, the individual members of cradle portion 510 may be formed from any material with a sufficient degree of rigidity, strength, and resilience to withstand the weight of the goods to be loaded in basket 520 and the vertical stacking of multiple containers 500. One material that is particularly well suited for the construction of cradle portion 510 is wood. The individual members may be joined together using one or more of a number of known techniques for joining the type of material the members are formed from, including mechanical and adhesive techniques. When the material is wood, the use of a plurality of lag screws 2 at each point of affixation is an effective means of joining the individual members together to form cradle portion 510. Alternatively, nails, particularly ring shank nails, or staples may be used to join the various members.

Figure 13:
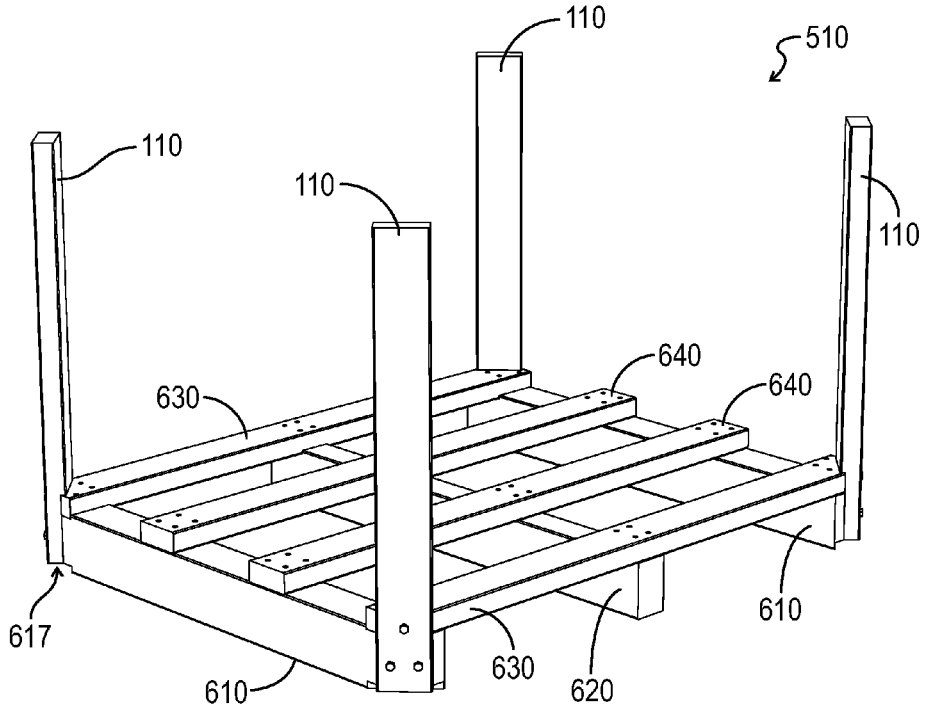
FIG. 13 is a perspective view of the cradle portion of the embodiment of the invention illustrated in FIG. 12.
Figure 14:
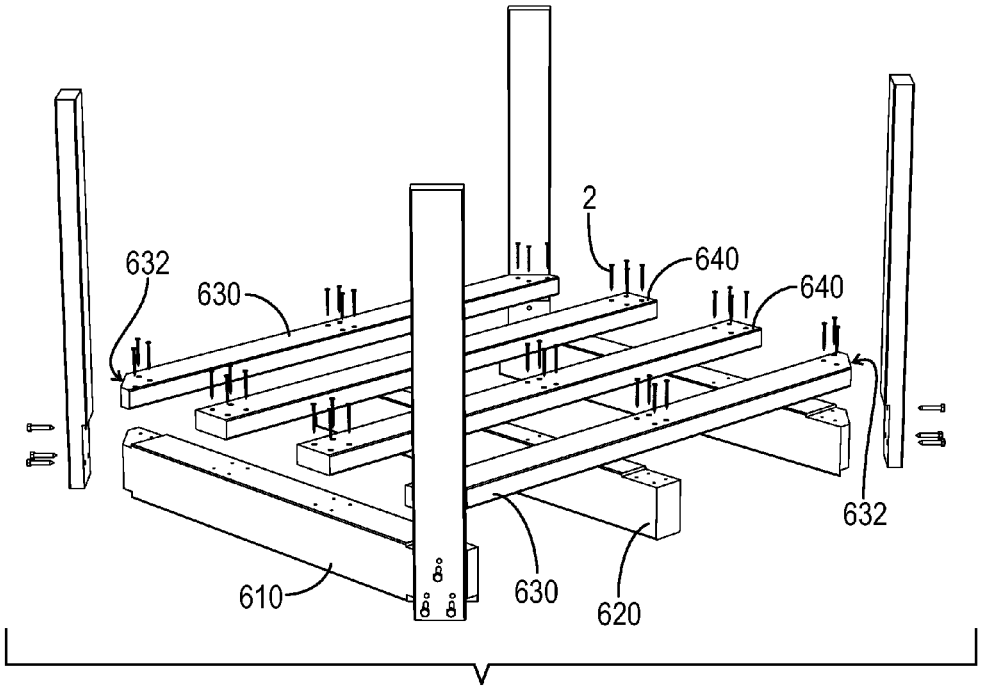
FIG. 14 is an exploded perspective view of the cradle portion of the embodiment of the invention illustrated in FIG. 12.

Referring now to FIGS. 13 and 14, base assembly 600 is further comprised of opposing outer runners 610, one or more intermediate runners 620, each of said runners being parallel to the remaining runners. Each outer runner 610 includes two mating surfaces 612, which are formed at a 45 degree angle to outer surface 611 of outer runner 610. Each outer runner 610 further includes rabbets 614 that are bounded by interlocking walls 615 that run parallel to mating surfaces 612. Outer runners 610 may include rabbets 613 opposite rabbets 614 to receive opposing outer basket support members 630.

Runners 610 and 620 are interconnected by opposing outer basket support members 630 and one or more intermediate basket support members 640. Each outer basket support member 630 includes two mating surfaces 632, which are formed at a 45 degree to the outer surface of outer basket support member 610. When outer basket support member 630 is connected to outer runner 610, each mating surface 632 of outer basket support member 630 cooperates with the corresponding mating surface 612 of outer runner 610 to form a planar surface for mating with upright member 110. While intermediate basket support members 640 are shown as extending across the width of base assembly 600, this is only an exemplary embodiment. Other orientations and lengths of intermediate basket support members 640 may be used as need to provide the required rigidity to base assembly 600. For example, diagonally oriented intermediate basket support members 640 may be used to increase the resistance of base assembly 600 to racking.

Figure 15:
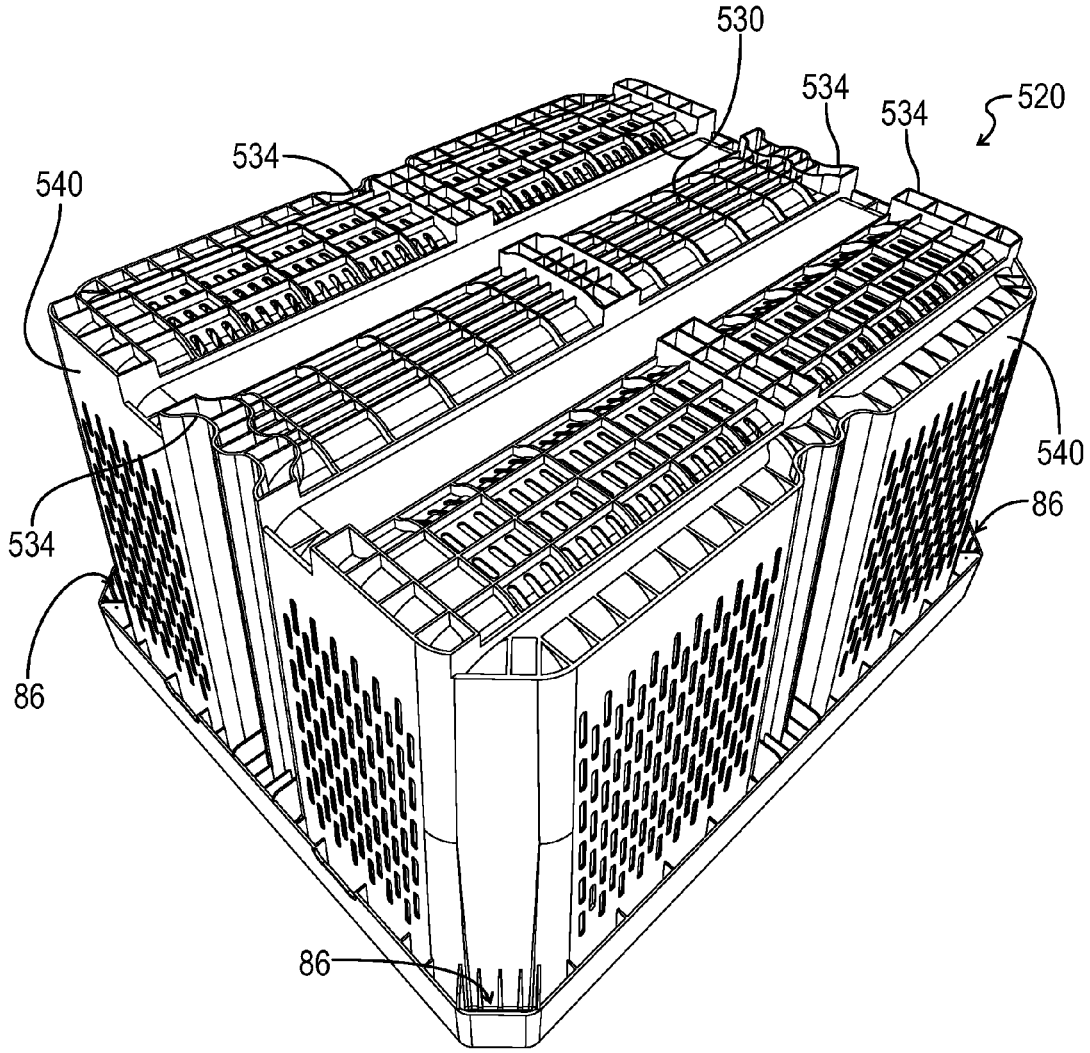
FIG. 15 is a perspective view of the basket of the embodiment of the invention illustrated in FIG. 12.
Figure 16:
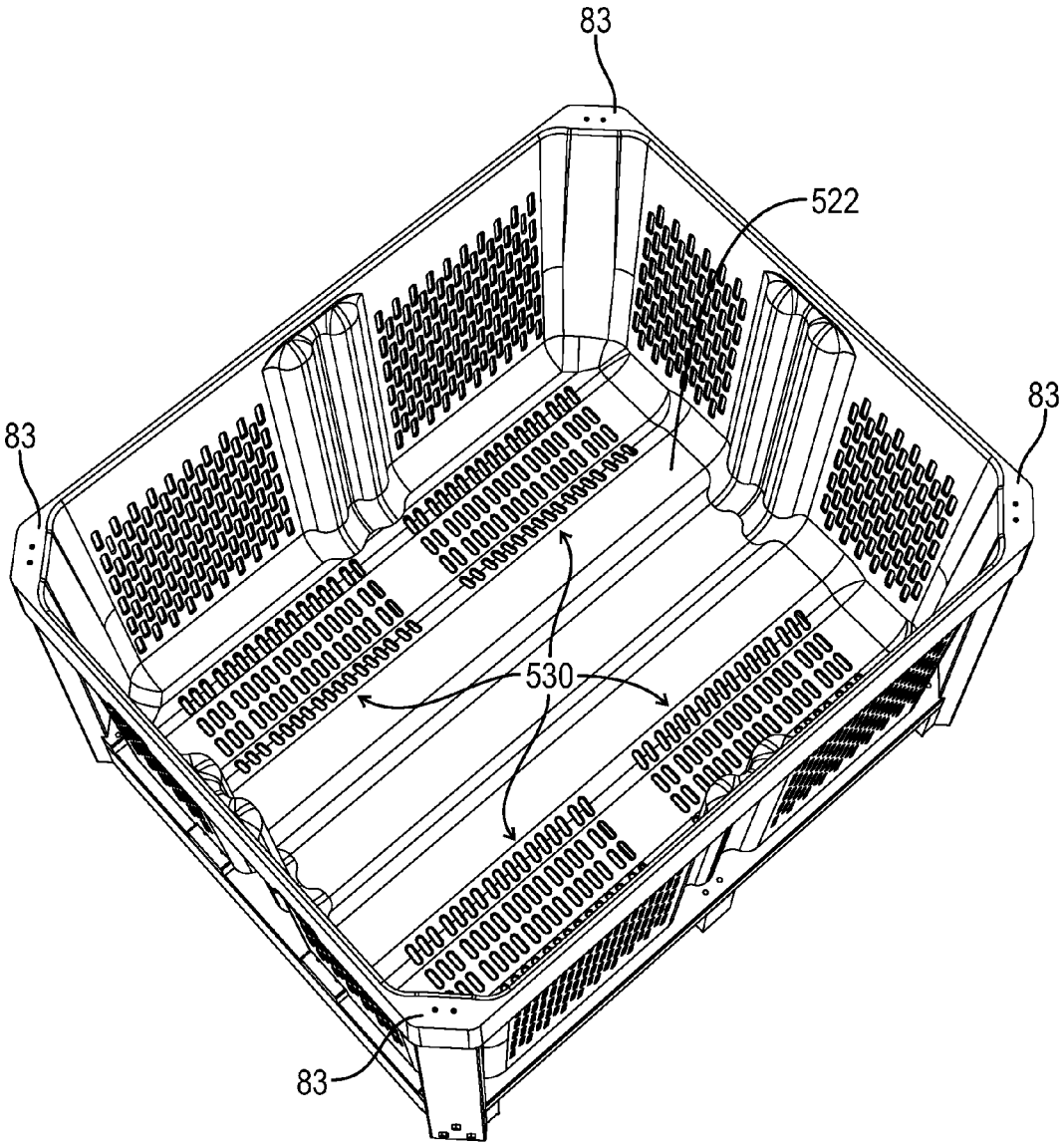
FIG. 16 is an alternate perspective view of the embodiment of the invention illustrated in FIG. 12.
Figure 17:
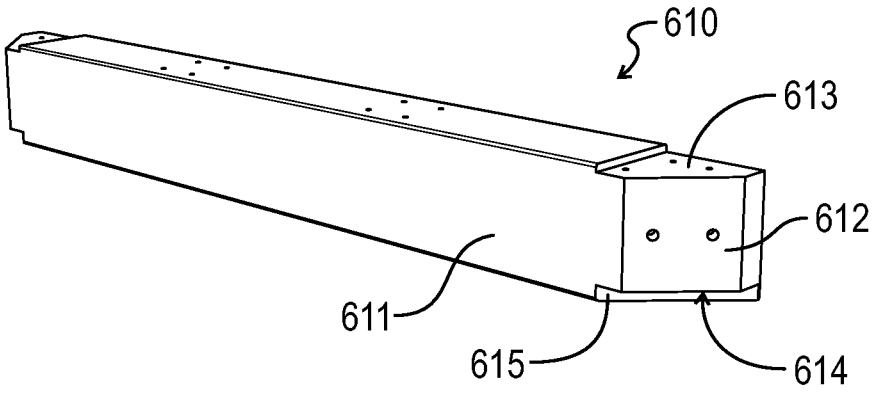
FIG. 17 is a perspective view of an outer runner of the embodiment of the invention illustrated in FIG. 12.
Figure 18:
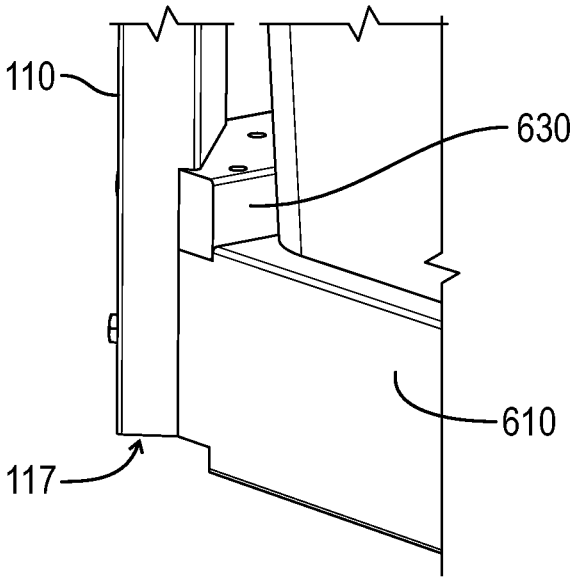
FIG. 18 is a partial perspective view of a portion the embodiment of the invention illustrated in FIG. 12.
Figure 19:
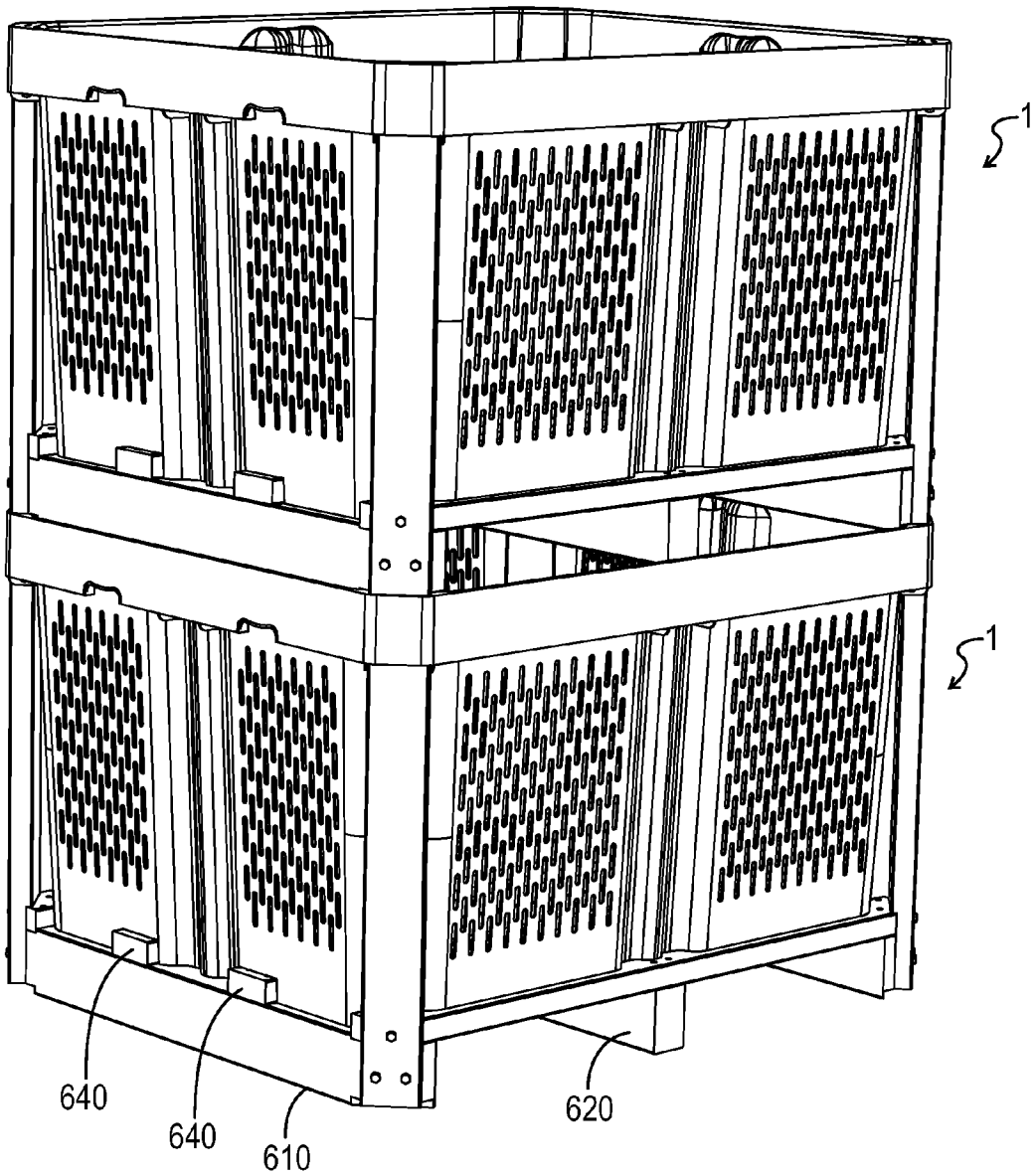
FIG. 19 is a perspective view showing a first container of the embodiment of the invention illustrated in FIG. 12 stacked on a second container of the same embodiment.

Referring now to FIG. 15, as in the embodiments discussed previously, basket 520 is preferably formed with sides 540 that are obtuse to floor 522 to enable the nesting of baskets 520 for shipment before baskets 520 are assembled into containers 500. The outer surface of floor 522 may be flat to rest on the upper surfaces of basket support members 610 and 620. To maximize volume, floor 522, may be formed with depressions 530 between the portions of floor 522 that align with basket support members 630 and 640. Depressions 530 are sufficiently shallow to ensure that the lower surface floor 522 does not extend below the lower surfaces of basket support members 630 and 640. To provide further support to basket 520, the outer surface of floor 522 may be provided with protruded areas 534 that align with and rest on portions of the upper surfaces of runners 610 and 620 that are not covered by basket support members 630 and 640. Basket 520 otherwise includes similar features to basket 20, including without limitation pockets 86 located in the upper portions of the corner portions of basket 520 and stacking areas 83 adjacent to pockets 86.

An upright member 110 is affixed to each corner of base 600 such that mating surface 116 of upright member 110 is adjacent to the planar surface formed by mating surface 632 of outer basket support member 630 and mating surface 612 of runner 610, and ledge 114 of upright member 110 rests on the upper surface of outer basket support member 630. Mating surface 116 is provided with a perpendicular length from ledge 114 such that lower surface 111 is co-planar with and cooperates with rabbet 614 of runner 610 to form stacking surface 617. Ledge 114 has a depth equal to the depth of rabbet 614 as measured perpendicularly from mating surface 612.

The foregoing described embodiments are exemplary in nature and are not intended to limit the scope of the invention.

I claim:

1. A shipping container comprising:

a cradle portion, said cradle portion being formed of a first material and further comprising a rectangular base assembly having a stacking surface defined in each corner portion of said base assembly and a plurality upright members arising from said corner portions of the base assembly; and a basket formed of a second material, said basket having a rectangular floor, a sidewall arising from a perimeter portion of said floor, said sidewall further comprising four corner portions in alignment with each corner portion of said base assembly, a stacking pad defined by an upper surface of each corner portion of said sidewall, a pocket defined in an upper portion each corner portion of said side wall, each pocket being adjacent to and underneath one of said stacking pads;

wherein the floor of said basket is supported by said base assembly and an upper portion of each said upright member is contained within one of said pockets.

2. The shipping container of claim 1 wherein when a first shipping container is stacked on a second shipping container, the stacking surfaces of the first container align with the stacking pads of the second container such that the vertical load of the first container is transferred to the second container solely through the stacking pads of the second container.

3. The shipping container of claim 2 wherein said base assembly further comprises a plurality of interlocking walls, each said interlocking wall extending downward from one of said stacking surfaces and being located such that when a first container is stacked on a second container, each interlocking wall extends into the basket of the second container.

4. The shipping container of claim 1 wherein the sidewall of said basket forms an obtuse angle with respect to the floor of said basket to enable a first basket to nest with a second basket.

5. The shipping container of claim 3 wherein said cradle portion is formed of a first material and said basket is formed of a different material.

6. The shipping container of claim 3 wherein the cradle portion is formed of wood and the basket portion is formed of a polymeric material.

7. A shipping container comprising:

a cradle portion, said cradle portion further comprising a base assembly, said base assembly having a rectangular shape wherein each corner portion is chamfered, a bottom surface, a rabbet defined in the bottom surface of said base assembly at each corner portion of said base assembly, and an interlocking wall extending downward from an inner portion of each rabbet to the bottom surface of said base assembly;

an upright member extending upward from each chamfered corner portion of said base assembly, each said upright member having a lower surface, said lower surface of each upright member being co-planar with and cooperating with the rabbet defined in the corresponding bottom portion of each chamfered corner portion to form a stacking surface;

a basket, said basket having four sides, wherein each pair of adjacent sides is connected by a chamfered corner portion, each said chamfered corner portion including a stacking pad at an upper end said chamfered corner portion and a pocket adjacent to and underneath said stacking pad wherein an upper end portion of each upright member is contained within said pocket and supports said corresponding stacking pad.

8. The shipping container of claim 7 wherein each upright member further comprises:

a mating surface aligned with and adjacent to an outer surface of said chamfered corner portion and a ledge perpendicular to said mating surface, said ledge being aligned with and adjacent to an upper surface of said chamfered corner portion.

9. The shipping container of claim 7 wherein when a first shipping container is stacked on a second shipping container:

the stacking surfaces of the first container align with the stacking pads of the second container such that the vertical load of the first container is transferred to the second container solely through the stacking pads of the second container and the interlocking walls of the first container extend into the corner portions of the basket of the second container to interlock said first container and said second container.

10. The shipping container of claim 7 wherein the sides of said basket form an obtuse angle with respect to the floor of said basket to enable a first basket to nest with a second basket.

11. The shipping container of claim 7 wherein said cradle portion is formed of a first material and said basket is formed of a different material.

12. The shipping container of claim 7 wherein the cradle portion is formed of wood and the basket portion is formed of a polymeric material.

13. A shipping container comprising:

a base portion, said base portion having a pair of opposing outer runners, each outer runner having opposing end portions, a vertical mating surface formed at a 45 degree angle to an outer surface of said outer runner at each opposing end portion and a rabbet formed in a bottom surface of each outer runner at each opposing end portion, each rabbet being defined by an interlocking wall parallel to the mating surface formed in the corresponding end portion, one or more intermediate runners located between and parallel to said outer runners, each said intermediate runner having opposing end portions, opposing outer basket support members, each opposing outer basket support member being transverse to and interconnecting the opposing end portions of said runners, the end portions of each opposing basket support member being congruent with the angled end portions of the outer runners;

one or more intermediate basket supports located between said outer basket support members, each intermediate basket support members interconnecting two or more of the runners;

an upright member extending upward from each corner of said base portion, each upright member having a mating surface aligned with and adjacent to one of said vertical mating surfaces of said outer runners a ledge perpendicular to said mating surface, said ledge being aligned with and adjacent to the upper surface of an end portion of one of said outer basket support members, and a lower surface, said lower surface being co-planar with and cooperating with said rabbet to form a stacking surface;

a basket, said basket having a floor, said floor being adjacent to the upper surfaces of the outer basket supports and the one or more intermediate basket supports;

four sides extending upward from a perimeter portion of said floor, each pair of adjacent sides being connected by a chamfered corner portion, each said chamfered corner portion including a stacking pad at an upper end said chamfered corner portion and a pocket adjacent to and underneath said stacking pad wherein an upper end portion of each upright member is contained within said pocket.

14. The shipping container of claim 13 wherein the sides of said basket are angled outward to enable a first basket to nest with a second basket.

15. The shipping container of claim 13 wherein the base portion and the upright members are formed of a first material and the basket is formed of a second material.

16. The shipping container of claim 15 wherein said first material is wood and said second material is a polymeric material.

17. The shipping container of claim 14 wherein when a first container is stacked on top of a second container:

the stacking surfaces of the first container align with the stacking pads of the second container such that the vertical load of the first container is transferred to the second container solely through the stacking pads of the second container and the interlocking walls of the first container extend into the corner portions of the basket of the second container to interlock said first container and said second container.

18. The shipping container of claim 14 wherein when a first container is stacked on top of a second container the only points of contact between said containers are the stacking surfaces of the first container and the stacking pads of the second container.

* * * * *